United States Patent [19]

Scholze et al.

[11] Patent Number: 4,505,439

[45] Date of Patent: Mar. 19, 1985

[54] ARRANGEMENT FOR THE CLAMPING OF A WARP BEAM TUBE OR THE LIKE

[75] Inventors: Gottfried Scholze; Dietrich Scholze; Johannes Maier, all of Frankenberg, Fed. Rep. of Germany

[73] Assignee: Erich Scholze GmbH & Co. KG, Fed. Rep. of Germany

[21] Appl. No.: 454,272

[22] Filed: Dec. 29, 1982

[30] Foreign Application Priority Data

Oct. 5, 1982 [DE] Fed. Rep. of Germany ..... 3236798

[51] Int. Cl.[3] ..... F16D 1/06; F16B 2/06; F16B 7/04

[52] U.S. Cl. ..... 242/68.4; 242/129.7; 269/78; 403/287

[58] Field of Search ..... 242/68.3, 68.4, 129.6, 242/129.7; 269/287, 77, 78; 403/287, 301, 302, 309, 313, 373, 344

[56] References Cited

U.S. PATENT DOCUMENTS

| | | | |
|---|---|---|---|
| 542,166 | 7/1895 | Lorah | 403/344 X |
| 939,744 | 11/1909 | Richardson | 403/301 X |
| 3,917,424 | 11/1975 | Zugel | 403/287 |
| 4,217,061 | 8/1980 | Eiland et al. | 403/313 |

FOREIGN PATENT DOCUMENTS

| | | | |
|---|---|---|---|
| 559006 | 3/1957 | Italy | 403/344 |
| 140870 | 8/1960 | U.S.S.R. | 403/344 |

*Primary Examiner*—Stuart S. Levy
*Assistant Examiner*—Lloyd D. Doigan
*Attorney, Agent, or Firm*—Goodman & Teitelbaum

[57] ABSTRACT

The invention relates to an arrangement for clamping a warp beam tube or the like to a square rod, in which a flange is fixed on the axial end of the beam tube, the flange including a square axial opening for the reception of the square rod. The flange is clampable fast by at least one clamping screw to the corresponding axial end of the square rod. For providing a central clamping-in not subject to the danger of loosening, the flange is constructed as a clamping ring which includes at least one slit extending through from the square opening to the outer circumferential surface of the clamping ring. The slit is bridged by at least one tightening screw and its width is reducible by a tightening of the tightening screw.

3 Claims, 2 Drawing Figures

ARRANGEMENT FOR THE CLAMPING OF A WARP BEAM TUBE OR THE LIKE

Figure 1:
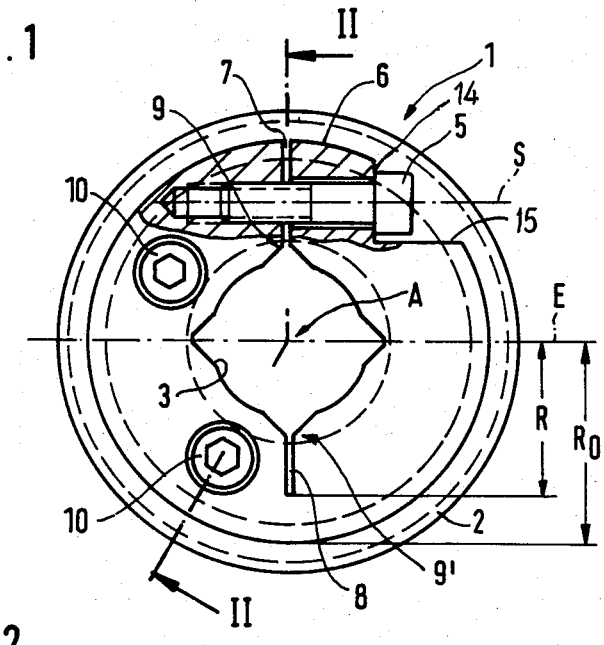

This invention relates to an arrangement for clamping a warp beam tube or the like to a square rod, in which a flange is fixed on the respective axial end of the beam tube. The flange includes a square axial opening for the reception of the square rod and is clampable by means of at least one clamping screw to the corresponding axial end of the square rod.

The bearing of warp beams or the like cloth beams in weaving looms, finishing machine frames and the like, at present on the market, is accomplished preferably with the aid of inserted square rods serving as shafts, which are fixed in collar-form square insets welded into the respective axial end of the beam tube. The screw clamping, hitherto of the above mentioned type, is accomplished by the tightening of the tightening screws present in the square inset, or in the beam tube, directly against the square rod. This clamping does not permit using an additional safety ring or additional safeguard, since the screw length is limited and, for constructive reasons, the screw movement is permitted to occur only over a few millimeters. Through the vibrations which weaving machines generate especially during the weaving process, the known clamping arrangement loosen or become detached, as experience has shown. For this reason there have already been undertaken many attempts to remedy this defect, but in vain.

For the production of a faultless fabric, there is required as uniform as possible a winding of the warp threads on the warp beam. This process can be achieved only when there is already means in the beaming on the finishing machine stand to provide for an exact centering of the beam on the axis. The same then holds true also for the weaving machine, in which, as mentioned, to an increased degree there is present the danger of loosening of the clamping by vibrations. In the absence of centering and/or loosening, the warp beam tube strikes on the square rod, whereby the threads pulled off from the beam have an uneven tension. This, in turn, leads to difficulties in the weaving. Since the force of the ordinarily used two clamping screws per side did not suffice to fix the beam centrally on the square axis, there were undertaken even more rebuildings of the weaving machines, in which the warp beam collar was made longer, in order to make it possible to accommodate, instead of the two screws, four clamping screws acting on the square rod. But these attempts to solve the problem were likewise without success, as well as the attempts to work with plasticlike safeguarding material, which lead to the disadvantage of a scuffing of the screw thread.

The problem of the present invention, therefore, is to further develop an arrangement of this type in such a way that it is possible to provide a faultless central clamping of warp beam tubes or the like to square rods with reduced danger of loosening.

This problem is solved with the present invention by the means that the flange is constructed as a clamping ring, which presents at least one continuous slit from the square opening to its outer circumferential surface, which slit is bridged by at least one clamping screw and its width is reducible by tightening of the clamping screw. In the proposal of the present invention, the clamping screws do not, therefore, as hitherto act directly on the square rod, but serve exclusively for the clamping together of the respective clamping ring. The slit permitting the tightening of the clamping ring is dimensioned in such a way that the slit boundary surfaces in the clamping of the beam tube on the square rod do, to be sure, move toward one another, but they do not touch, since before this the boundary surfaces of the square opening come into engagement on the surface of the square rod. It is surprising that the clamping arrangement of the present invention permits a faultless central clamping in place and, despite the considerable vibrations on the weaving machine, does not loosen.

In order to assure the clamping in place symmetrically without problems, the slit runs advantageously radially or substantially radially to the clamping ring.

The axis of the clamping screw runs, in a preferred embodiment of the present invention, in a section line of the middle plane of the clamping ring with a plane parallel to a plane containing the beam tube axis.

In order to facilitate the clamping in place, the clamping ring can present, preferably diametrically opposite the slit, a partial slit, which, to be sure, likewise proceeds from the square opening, but ends at a selected distance before reading the outer circumferential surface. The clamping ring thereby acquires a greater flexibility.

The partial slit, too, runs preferably radially or substantially radially to the clamping ring, in order to ensure the symmetrical clamping in place.

In further advantageous development of the present invention, it is provided that the slit and possibly also the partial slit proceed in each case from a corner of the square opening. It has proved that in this manner, the central clamping-in is especially favored.

With the present invention, it is now possible for at least one clamping screw also to carry a security ring, which was not the case hitherto.

A preferred development of the present invention consists, further, in that the clamping ring is fixable with at least one axial screw to a tube flange welded within the beam tube. While hitherto it was necessary for each square rod dimension to acquire a special beam type with corresponding square opening or else at least there was needed a base tube with expensive change insets, with this development of the present invention through uncomplicated changing of the clamping ring, any desired type of beam can be used. This requires neither a time-consuming assembly as in the case of the change insets known per se, nor increased costs. The object of the present invention permits, therefore, a more versatile and, consequently, also more economical use of a beam tube.

It is expedient that at least one axial screw lies on one side of the plane passing through the slit and possibly the partial slit, in order not to impair the clamping action.

Further aims, features, advantages and possibilities of use of the present invention are yielded from the following description of an example of execution with the aid of the appended drawing. There, all described and/or pictorially represented features by themselves or in any reasonable combination form the object of the present invention.

Figure 2:
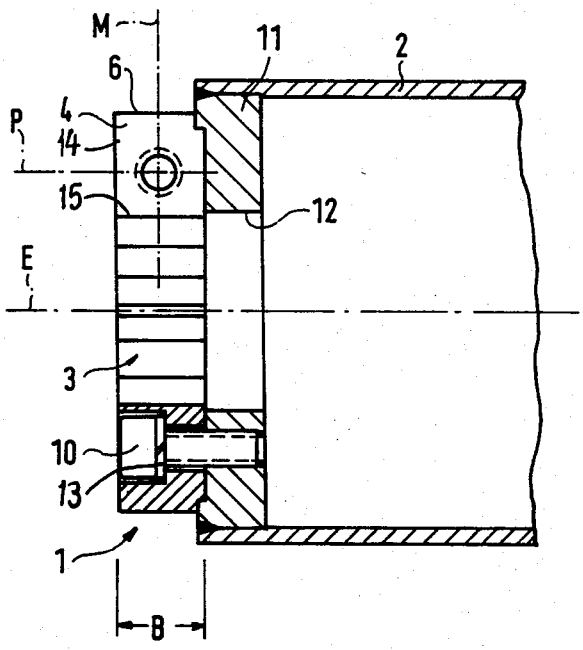

In the drawings:

FIG. 1 shows an end view of the clamping arrangement presenting the invention, in part sectioned; and FIG. 2 shows a longitudinal section through the end of a warp beam tube with the clamping arrangement presenting the invention, corresponding to the section line II—II of FIG. 1.

The clamping arrangement 1 is provided on a specific axial end of a beam tube 2. Into the end of the beam tube 2, there is welded a tube flange 11 with a round aperture 12 therethrough for the insertion of a square tube (not represented). Onto the tube flange 11, there is screwed fast from outside, a flange constructed as a clamping ring 4, being secured with two axial screws 10, each being provided with a conventional safety ring 13 well known in the art. The clamping ring 4 has a square opening 3 corresponding to the dimension of the square tube, which opening lies concentrically to the round aperture 12. Square opening 3 and round aperture 12 have a common middle axis A, which is also the middle axis of the clamping ring 4 and of the beam tube 2. Proceeding from a corner, in the case represented being the upper corner 9 of the square opening 3, the clamping ring 4 presents a slit 7, which extends to the outer circumferential surface 6 of the clamping ring 4. In the zone of the slit 7, there is borne in the clamping ring 4 a tightening screw 5, which runs with its axis S perpendicularly to the plane of the slit 7 and penetrates this plane. In the tightening of the tightening screw 5, constructed in the case represented as a socket head cap screw, the gap of the slit 7 narrows with the deformation of the clamping ring 4, thus narrowing the size of the square opening 3. In this manner, there takes place a central clamping-in of a square rod received in the square opening 3. Through the feature that the screws 10 both lie on the same side of the plane of the slit 7, the tightening of the clamping ring 4 by the tightening of the tightening screw 5, is not hampered. Proceeding from the corner 9′ lying diametrically opposite the upper corner, 9, the clamping ring 4 presents a partial slit 8 which begins, to be sure, also at the square opening 3, but reaches only to the radius R and not to the total radius $R_0$ of the clamping ring 4. The two halves, determined by slit 7 and partial slit 8, of the clamping ring 4 are therefore now as before joined with one another, and form, therefore, one piece. The partial slit 8 ensures an increased elasticity of the clamping ring 4 for clamping fast on the square rod. By reason of the position of slit 7 and partial slit 8, there occurs a faultless centering of the square rod in the tightening of the clamping screw 5.

From FIGS. 1 and 2, it is evident that the clamping (tightening) screw 5, in contrast to the known clamping arrangements, is directed with its axis S not upon the square rod, but this axis S runs in the intersection line between the middle plane M of the clamping ring 4 and a plane P, where the plane P runs parallel to a plane E, which in the case represented, the plane E is a horizontal plane which contains the beam tube axis A.

The example of execution represented is suited for the clamping fast of warp beams and the like to square insert rods. With use of square insert rods, it is possible to execute the clamping ring 4 in a greater width than its presently shown width B, and to use more than one tightening screw 5 in axial spacing from one another. The greater width of the clamping ring 4 serves the purpose of holding the square insert rods faultlessly axially parallel to the beam tube 2.

As shown in the drawings, the circumferential surface 6 of the clamping ring 4 is recessed to provide a base wall 14 and a side wall 15, where the head of the clamping screw 5 engages against the base wall 14. Accordingly, this recess in the circumferential surface 6, which receives the clamping screw 5, permits the clamping screw 5 to carry a safety ring (not shown) if desired, where the safety ring could be similar to the above mentioned safety ring 13 provided on the axial screw 10.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Arrangement for clamping a warp beam tube and the like to a square rod, said arrangement comprising:

a flange fixed to an axial end of the beam tube, said flange being constructed as a one piece clamping ring;

said clamping ring including a square axial opening for reception of the square rod to provide for a central clamping-in of the square rod;

a first slit extending through said clamping ring from one corner of said square opening to an outer circumferential surface of said clamping ring, said first slit having a selected width;

a second partial slit being diametrically opposite said first slit and extending through said clamping ring from an opposite corner of said square opening in an opposite direction than said first slit and ending at a spaced distance from said outer circumferential surface of said ring;

said first slit and said second partial slit running substantially radially to said clamping ring to facilitate said central clamping-in of the square rod;

said first slit, said square opening and said second partial slit communicating with each other to divide said clamping ring into a first section and a second section;

securing means for only fixing said first section to the axial end of the beam tube so that said second section can pivotally move relative to said first section; and said first slit being bridged by at least one clamping screw so that said selected width of said first slit is reducible by a tightening of said clamping screw;

whereby said second section pivotally moves toward said first section when said clamping screw is tightened to provide for said central clamping-in of the square rod within said square axial opening.

2. Arrangement according to claim 1, wherein said clamping ring includes receiving means for receiving said clamping screw, whereby said receiving means permits said clamping screw to carry a safety ring.

3. Arrangement according to claim 1, wherein said securing means includes at least one axial screw for only securing said first section of said clamping ring to a tube flange welded within the beam tube.

* * * * *